US012371811B2

(12) United States Patent
Wiener et al.

(10) Patent No.: US 12,371,811 B2
(45) Date of Patent: Jul. 29, 2025

(54) APPARATUS FOR WET PROCESSING OF A PLANAR WORKPIECE, DEVICE FOR A CELL OF THE APPARATUS AND METHOD OF OPERATING THE APPARATUS

(71) Applicant: Atotech Deutschland Gmbh & Co. KG, Berlin (DE)

(72) Inventors: Ferdinand Wiener, Berlin (DE); Henry Kunze, Berlin (DE); Britta Scheller, Berlin (DE)

(73) Assignee: Atotech Deutschland GmbH & Co. KG, Berlin (DE)

( * ) Notice: Subject to any disclaimer, the term of this patent is extended or adjusted under 35 U.S.C. 154(b) by 435 days.

(21) Appl. No.: 17/642,388

(22) PCT Filed: Sep. 11, 2020

(86) PCT No.: PCT/EP2020/075459
§ 371 (c)(1),
(2) Date: Mar. 11, 2022

(87) PCT Pub. No.: WO2021/048343
PCT Pub. Date: Mar. 18, 2021

(65) Prior Publication Data

US 2022/0325429 A1 Oct. 13, 2022

(30) Foreign Application Priority Data

Sep. 12, 2019 (EP) ..... 19196994

(51) Int. Cl.
*C25D 17/00* (2006.01)
*C25D 5/08* (2006.01)
*C25D 7/00* (2006.01)

(52) U.S. Cl.
CPC ..... *C25D 17/00* (2013.01); *C25D 5/08* (2013.01); *C25D 7/00* (2013.01)

(58) Field of Classification Search
None
See application file for complete search history.

(56) References Cited

U.S. PATENT DOCUMENTS 5,425,862 A 6/1995 Hartmann et al.
6,238,529 B1 5/2001 Geissler et al.
(Continued)

FOREIGN PATENT DOCUMENTS

CN 204874804 U * 12/2015
DE 4229403 A1 * 3/1994 ..... C25D 5/56
(Continued)

OTHER PUBLICATIONS

English translation CN 203034115 (Year: 2013).*
(Continued)

*Primary Examiner* — Stefanie S Wittenberg
(74) *Attorney, Agent, or Firm* — Renner, Otto, Boisselle & Sklar, LLP

(57) ABSTRACT

A device for a cell of an apparatus for wet processing of a planar workpiece, comprises a structure comprising first and second walls. The workpiece is movable in a central plane through a space between the first and second walls in a first direction (y). Apertures for introducing pressurised liquid between the first and second walls are on opposite sides of the central plane and facing the central plane. The apertures are distributed in the first direction (y) and in a second direction (x) transverse to the first direction (y). Discharge openings for the liquid to leave the space are on opposite sides, in the second direction (x), along the space in the first direction (y). The first and second walls form barriers to liquid flow from the space in a direction (z) perpendicular to the central plane. Channels through the walls are arranged to conduct liquid to respective one of the apertures.

19 Claims, 4 Drawing Sheets

(56) References Cited

U.S. PATENT DOCUMENTS

| | | | | |
|---|---|---|---|---|
| 2013/0186852 | A1* | 7/2013 | Dietrich | H01L 21/02 427/256 |
| 2015/0252488 | A1 | 9/2015 | Wiener et al. | |
| 2020/0276608 | A1* | 9/2020 | Okuda | C25D 5/08 |

FOREIGN PATENT DOCUMENTS

| | | | |
|---|---|---|---|
| JP | 2005272999 | A | 10/2005 |
| WO | 03018878 | A2 | 3/2003 |

OTHER PUBLICATIONS

English translation WO 2019058860 (Year: 2019).*
English translation CN 105051265 (Year: 2015).*
PCT/EP2020/075459; International Search Report and Written Opinion of the International Searching Authority dated Nov. 26, 2020.

* cited by examiner

APPARATUS FOR WET PROCESSING OF A PLANAR WORKPIECE, DEVICE FOR A CELL OF THE APPARATUS AND METHOD OF OPERATING THE APPARATUS

This application is a national phase of International Application No. PCT/EP2020/075459 filed 11 Sep. 2020, which claims priority to European Patent Application No. 19196994.8 filed 12 Sep. 2019, the entire disclosures of which are hereby incorporated by reference.

TECHNICAL FIELD

The invention relates to a device for a cell of an apparatus for wet processing of a planar workpiece, comprising:

a structure comprising first and second walls, wherein the workpiece is movable in a central plane through a space between the first and second walls in a first direction, wherein apertures for introducing pressurised liquid between the first and second walls are provided on opposite sides of the central plane and facing the central plane, wherein the apertures are distributed in the first direction and in a second direction transverse to the first direction, wherein discharge openings for the liquid to leave the space are defined on opposite sides, seen in the second direction, of the space along an extent of the space in the first direction, and wherein the first and second walls form barriers to liquid flow from the space in a direction perpendicular to the central plane.

The invention also relates to an apparatus for wet processing of a planar workpiece.

The invention also relates to a method of operating such an apparatus.

The invention also relates to a use of at least one of such a device and such an apparatus.

BACKGROUND ART

US 2015/0252488 A1 discloses a plater for wet chemical electrochemical treatment, wherein metal is electrochemically deposited onto the surface of the material to be treated. This device has side walls arranged on the sides, which extend parallel to the transport direction of the material to be treated, as well as a bottom wall that delimits the treatment chamber. Furthermore, the treatment chamber is closed transversely with respect to the transport direction by further side walls, which have slots for carrying through the material to be treated. To seal the liquid treatment chamber against treatment liquid flowing out, pairs of squeeze rollers are arranged on these slots, the material to be treated being conducted through between them when being conveyed into or out of the treatment chamber. The material to be treated is conveyed by means of wheels mounted to shafts at a certain distance to one another, the shafts extending transversely with respect to the transport direction. Anodes are arranged above and below the material to be treated. A transport plane extends in the transport direction in the treatment chamber. Viewed from the transport plane beyond the anodes, supply devices having nozzles are located above and below the material to be treated. The supply devices are formed by top and bottom pen stocks, which convey the treatment liquid via the nozzles on both sides to the surface of the material to be treated. The nozzles and the remaining components are arranged below a bath level in the treatment chamber. There is no wall above the supply devices that are located above the material to be treated, in use. The anodes do not form barriers to liquid flow from the space between the anodes in a direction perpendicular to the central plane. The wheels conveying the material to be treated contact the material to be treated at locations along the entire width of the material to be treated. This is undesirable where the material to be treated is relatively vulnerable, e.g. where it is covered by a photomask. If wheels were to be omitted, a relatively large distance would have to be maintained between the anodes and the material to be treated, in order to prevent the material from touching the anodes. Even so, undulations across the width of the material to be treated could lead to the formation of an uneven coating due to variations in the distance between the anode and the material.

DE 42 29 403 A1 discloses an apparatus with which thin plastic foils provided with through-bores can be plated on their upper and lower surfaces and the lateral surfaces of the through-bores. A plating chamber is provided with a housing, of which an inlet is formed by a pair of squeeze rollers and an outlet is formed by a pair of squeeze rollers. An upper anode and a lower anode extend above and below the plastic foil at a parallel spacing thereto. Respective distribution spaces for an electrolyte are provided between the anodes and the housing of the plating chamber. The anodes are provided with a plurality of through-bores, which are inclined with respect to a direction of movement of the plastic foil, such that they converge in the direction of movement. The arrangement is such that the electrolyte supplied to the distribution space through conduits enters a space between the anodes and the plastic foil with a movement component parallel to the direction of movement of the plastic foil. The electrolyte flows out through lateral openings in the housing, and from there to a sump in the apparatus. The lateral opening is provided at only one location along the length of the chamber. The plastic foil is spooled from and onto reels at either end of the apparatus and held tight and flat by the squeeze roller pairs. This arrangement is thus only suited for processing endless foils and requires tight contact between the squeeze rollers and the foil across the width of the foil.

WO 98/49374 A1 discloses an apparatus for electrolytically treating circuit boards and circuit foils in horizontal continuous apparatus using direct current or pulsed currents. The apparatus comprises upper and lower insoluble anodes that function as counter-electrodes. An electrolytic cell is formed by the upper anodes, the circuit board or circuit foil and the electrolyte space therebetween. The anodes extend essentially across a width of the workpiece. The circuit boards and circuit foils are conducted by upper and lower guide elements between the upper and lower anodes, preferably centrally, and are transported by clamps that also function as electrical contacting elements. The guide elements are generally electrically insulated narrow spindles with perforated discs of electrically non-conducting plastic mounted thereon. Electrolyte spray devices are arranged outside the electrolyte space on the sides of the counter-electrodes facing away from a transport plane. Spray tubes are provided with holes or nozzles that are directed perpendicularly or at an angle to the surface of the workpiece. Holes are provided in the anodes and positioned such that the treatment liquid that exits the holes or nozzles in the spray tubes can pass the anodes substantially or completely unhindered. However, the anodes do not form barriers preventing liquid flow from the transport plane in a direction perpendicular to the transport plane. The spray tubes are positioned at a substantial distance to upper and lower walls of the device. The perforated discs are therefore required to keep the circuit board or circuit foil in the transport plane.

A similar arrangement to the one shown in WO 98/49374 A1, but without the perforated discs on spindles, is used in a horizontal continuous plating apparatus currently available from the applicant. In this apparatus, spray bars provided on opposite sides of a plane in which the workpiece is arranged to be conveyed are directed at this plane. The distance from the spray bars to the plane of movement of the workpiece is relatively small. There is therefore a risk that thin workpieces will undulate and touch contact protection grids provided between the anodes and the plane of movement. In the case of dry film electroplating, the photomask may become detached from the workpiece as a consequence. Even if contact is avoided, undulations may become fixed due to the relatively rigid metal layer or layers formed on the surface or surfaces of the workpiece.

SUMMARY OF INVENTION

It is an object of the invention to provide a device, apparatus and method of the types defined above in the opening paragraphs that allow for the processing of relatively thin workpieces whilst keeping the workpieces in a single plane relatively well.

This object is achieved according to a first aspect by the device according to the invention, which is characterised in that channels are provided through the walls, each channel arranged to conduct liquid to a respective one of the apertures.

The device may be for forming a complete cell or be configured for placement in a bath to form the cell. In the latter case, the space accessible to liquid introduced between opposing surfaces of the first and second walls would be larger than a space section between these opposing surfaces. Multiple devices may be provided in a single bath to form a cell in an embodiment. The types of processing may in particular include wet chemical processing, e.g. at least one of chemical or electrolytic metal deposition, chemical or electrolytic etching and chemical or electrolytic cleaning. At least some of the liquid introduced through the apertures comprises a reactant, so that flow of the liquid over the surfaces of the workpiece results in replenishment of the reactant and thus more efficient processing. Surface treatment of the workpiece may be of only one or of both surfaces of the workpiece, but there is a flow of liquid across both surfaces.

In an embodiment, the device is for forming a cell configured for electroplating the workpiece, e.g. pulse-plating.

The workpiece may be a plate or foil. The workpiece may in particular be a discrete plate or piece of foil, in contrast to a foil transported from reel to reel through the apparatus. The device is particularly suited for apparatus for processing relatively thin, relatively flexible planar workpieces, e.g. having a thickness in the order of 10-100 μm, because such workpieces are more likely to flex. However, the device can also be used in apparatus for processing thicker workpieces.

The workpiece is movable in a central plane between the first and second walls in a first direction. The first direction, although also referred to herein as the longitudinal direction, is merely defined by the direction of movement. The first direction need not correspond to the largest dimension of the device or of the space into which liquid is introduced.

The device comprises a structure comprising first and second walls. These first and second walls need not be joined or form part of a single assembly. However, the first and second walls are mounted to present opposing surfaces delimiting at least part of a space accessible to liquid that is introduced between the walls. Liquid-permeable structures may be interposed between the walls. However, except for the channels, the walls are impervious to liquid, such that the walls form barriers. The first and second walls serve as backflow barriers with respect to the apertures for introducing liquid into the space between the walls. Thus, the first and second walls form part of a limit of a space accessible to the liquid introduced between the walls. Such liquid is prevented from flowing directly from the sides of the first and second walls closest to the central plane to opposite sides of the first and second walls, but the liquid may be collected and returned as pressurised liquid by a recirculation system comprising at least one pump.

Channels are provided through the first and second walls, each channel arranged to conduct liquid to a respective one of a plurality of apertures for introducing liquid into the space between the first and second walls. The apertures for introducing liquid are provided on opposite sides of the central plane and facing the central plane. Thus, the direction of flow is predominantly towards the discharge openings and, close to the apertures, otherwise towards the central plane. In order to establish such a flow field, the apertures may be defined in the surfaces at ends of the respective channels. Where they are defined at the distal ends of nozzles protruding from the surface, these nozzles protrude only a relatively short distance from the surface, such that the wall concerned still functions as a backflow barrier.

Because the apertures are distributed in the first direction and in a second, or lateral, direction transverse to the first direction, pressurised liquid is introduced at multiple locations across the surfaces of the walls. This results in a flow of liquid accelerating in opposite lateral directions towards the discharge openings. In operation, the discharge openings are located at the lateral edges of the workpiece moving through the device. There is limited or no flow in the first direction, depending on the extent to which the space through which the workpiece is movable is closed at the longitudinal ends of that space.

Any section of the planar workpiece that deviates from the central plane towards one of the opposing surface will locally narrow the already narrow gap between that surface and the workpiece. The flow is pinched and the pressure locally increased as a result. Pressures decreases locally on an opposite side of the workpiece. The resulting force will tend to return the workpiece section towards the central plane. This restorative effect is not achievable by means of nozzles directing diverging jets onto the surfaces of the workpiece, because any workpiece section moving closer to a nozzle orifice would be subjected to a local impulse, but not to a net force returning this section to the central plane. This is because there is no backflow barrier directly behind the nozzle.

By contrast, in the present device, the workpiece is kept substantially in the central plane by the flows of liquid on either side. Consequently, the space through which the workpiece is movable can have a relatively small height. The amount of liquid to be circulated is thus relatively low and the device is relatively compact. Unintended contact between the surface of the workpiece and the device is avoided. Solid guide elements that contact the workpiece surfaces away from lateral edges of the workpiece can be dispensed with, at least between the longitudinal ends of the device. The workpiece need not be held under tension in the second, lateral direction.

Because the discharge openings for the liquid are defined on opposite sides of the space, seen in the second direction, and are provided along the extent in the first direction of the space, the flow of liquid is directed outwards from the middle in both lateral directions. If the flow were to be only from one edge of the workpiece to the opposite edge in the second direction, a thin workpiece would start to flutter like a flag in the wind, especially if only supported at only one of those edges.

As mentioned, in an embodiment of the device, the apertures are defined in surfaces of the first and second walls at ends of the respective channels.

That is to say that the channels are essentially through-bores in the first and second walls. The channel ends at the apertures are at least flush with the wall surface. This firstly helps establish the desired flow field. Secondly, the first and second walls can be positioned closer together.

An embodiment comprises first and second liquid distribution devices, the first and second walls comprise walls of the first and second liquid distribution devices, respectively, and wherein the liquid distribution devices are mounted such that the space extends between the liquid distribution devices.

This embodiment has relatively few parts.

In an embodiment of the device, at least one liquid distribution space extending in the second direction across inlets of the channels is defined on an opposite side of at least one of the first and second walls to the space.

There may in particular be a first liquid distribution space on an opposite side of the first wall to the side facing in the direction of the central plane, and a second liquid distribution space on an opposite side of the second wall to the side facing in the direction of the central plane. Where the device comprises first and second liquid distribution devices, the liquid distribution spaces may be defined in respective chambers of the liquid distribution devices. The liquid distribution spaces equalise the liquid pressure on the upstream side of the channels through the first and second walls. Thus, each liquid distribution space generally extends in the first and in the second direction across inlets of a plurality of the channels. Each liquid distribution space may, for example, extend across substantially an extent in the first and/or second direction of the wall on the side of which that liquid distribution space is defined.

In a particular example of this embodiment, the liquid distribution space is delimited by a barrier, inclined with respect to the wall such that the liquid distribution space tapers towards an edge of the wall.

An effect is that liquid need only be introduced into the liquid distribution space on one side of the liquid distribution space. The liquid may be introduced through one or more elongated apertures extending in the first or the second direction at or close to and generally parallel to an edge of the liquid distribution space. The liquid distribution space decreases in height (with respect to the first or second wall) towards an opposite edge. As a result, a relatively uniform exit velocity of the liquid across the apertures is achieved without providing liquid inlets for pumping liquid into the liquid distribution space along multiple edges of the liquid distribution space.

An example of the embodiment of the device in which a liquid distribution space is defined on an opposite side of at least one of the first and second walls to the space comprises at least one divergent liquid conduit, having an inlet connectable to a liquid supply conduit on one side and widening towards an opposite side that is in liquid communication with the liquid distribution space at multiple locations along a width of the divergent liquid conduit.

This embodiment requires only a limited number of connections to tubular conduits conveying liquid from a pump. A uniform flow along an edge of the liquid distribution space is nevertheless achieved. In an embodiment, the divergent conduit may be provided with flow guides along at least part of its length, e.g. at a wider end of the divergent conduit. This helps avoid turbulence. Liquid communication with the liquid distribution space at multiple locations along a width of the divergent liquid conduit may be through multiple discrete apertures distributed along the width of the divergent liquid conduit. Alternatively, a single aperture may extend along a majority of the width of the divergent liquid conduit, e.g. substantially the entire width, corresponding to at least 90% or at least 95% of the width of the divergent liquid conduit.

In an example of this embodiment of the device which comprises first and second liquid distribution devices, wherein the first and second walls comprise walls of the first and second liquid distribution devices, respectively, and wherein the liquid distribution devices are mounted such that the space extends between the liquid distribution devices, the divergent liquid conduit and the liquid distribution space are defined within a chamber within a housing of one of the first and second liquid distribution devices by a barrier extending within the chamber.

This results in a compact construction with relatively few sealed connections between different components and thus a relatively low risk of leakage.

In an embodiment of the device, at least one of the discharge openings is formed by a single gap extending between opposing liquid-impervious parts, e.g. edges of the first and second walls, along the extent in the first direction of the space.

An effect is that either an edge section of the workpiece can extend through the discharge opening and be held outside the space between the first and second walls, or at least part of a conveying device for holding the workpiece at an edge of the workpiece can extend through the discharge opening into that space. In the latter case, the part holding the workpiece can be effective to move the workpiece in longitudinal direction through the device. In the former case, the parts holding the workpiece can at least support the workpiece as the workpiece moves through the device, but they may also move the workpiece through the device.

In an embodiment, each discharge opening has a height of at most 100 mm, e.g. at most 50 mm or even less than 40 mm.

In this connection, the term height refers to a dimension transverse to the central plane.

The relatively small height allows the effect that sections of the workpiece are returned to the central plane when they move out of that plane to be achieved with flow rates of at most 10 m/s, for example less than 8 m/s or even less than 5 m/s. The minimum flow rate can be, for example, 0.1 or 0.5 m/s.

An embodiment further comprises at least one liquid-pervious electrode, e.g. a planar electrode, extending in a plane between the central plane and one of the first and second walls.

This embodiment is for an electroplating cell. There may in particular be a first liquid-pervious electrode, e.g. a first planar electrode, extending in a plane between the central plane and the first wall and a second liquid-pervious electrode, e.g. a planar electrode, extending in a plane between the central plane and the second wall. The risk of even relatively thin workpieces coming too close to the electrode or electrodes due to undulations is relatively low. This results in a low risk of damage due to physical contact, as well as a reliably uniform plating thickness. The electrodes may in one embodiment comprise meshes. Each electrode may be sub-divided into mutually electrically isolated segments located in a plane of the electrode. An example of such a configuration and the effects thereof are described e.g. in WO 2003/018878 A2.

An embodiment further comprises at least one liquid-pervious shielding structure, e.g. a planar shielding structure, extending in a plane between the central plane and one of the first and second walls.

In an embodiment, such a shielding structure is provided on each side of the central plane. Where an electrode is provided on a respective side of the plane, the shielding structure is positioned between the central plane and that electrode. Thus, contact between the workpiece surface and the electrode is prevented under all circumstances. Such contact would otherwise lead to a short-circuit, since one of the workpiece and the electrode will generally form an anode and the other a cathode. Each shielding structure will generally be the solid structure closest to the central plane on the side of the central plane on which that shielding structure is provided. Each shielding structure may be made of electrically insulating material, e.g. polymer material. One way of implementing the shielding structure is to provide a plate of the electrically insulating material with a relatively large number of relatively small-diameter thoroughgoing channels. The surface density of such channels will be at least an order of magnitude larger than that of the apertures relative to the first and second walls. The diameter of the channels will be correspondingly smaller. For achieving uniform current densities, two or more neighbouring channels at certain locations may be linked by breaking away the material that would otherwise separate them. Alternatively or additionally, one or more channels may be plugged. In an example, a distance between the central plane and the shielding structure is between 2 mm and 15 mm, e.g. less than 10 mm or even less than 8 mm, in a device intended for use with workpieces having a thickness below 1 mm, e.g. below 100 μm or even below 50 μm. The shielding structure or structures are of particular use when processing discrete planar workpieces (i.e. sheets as opposed to continuous webs), because these enter the cell with an essentially unsupported free edge. The section of the workpiece at that edge may curve in the direction of movement.

In an embodiment of the device, nozzles extending to the apertures are provided in the first and second walls.

Generally, a respective nozzle will be provided for each aperture. The nozzles may be formed in the wall or the nozzles may be separate devices inserted into bores in the wall and fixed in position with respect to the wall. Generally, the apertures will correspond to exit orifices of the nozzles. However, exit orifices of nozzle devices may be set back somewhat with respect to apertures formed in a wall surface in an embodiment. Nozzle devices may protrude slightly from the bore in which they are arranged. Distinct nozzle devices will however, completely fill bores in the wall in which they are inserted. Thus, where distinct nozzle devices are provided, liquid cannot bypass these nozzle devices through the first and second walls. The nozzles allow the streams of liquid entering the space to be shaped, in that the nozzles deviate from circle-cylindrical channels.

In a particular example of this embodiment, orifices of the nozzles are provided with an elongated shape having a larger dimension in the second direction than in the first direction.

This has the effect of providing the required tangential flow field (from the centre outwards to the discharge opening along the surface of the workpiece) without having to decrease the mutual spacing between the apertures to an extreme extent, particularly in the first direction. Relatively uniform coverage of the workpiece surface with liquid is achieved. The nozzles may, for example, be fan nozzles, i.e. nozzles with a slit-shaped orifice. In a particular example of this embodiment, in which the device also comprises at least one liquid-pervious electrode, e.g. a planar electrode, extending in a plane between the central plane and one of the first and second walls, the electrode is provided with elongated liquid-pervious windows, e.g. apertures, aligned with respective nozzle orifices. The liquid-pervious windows in the electrode can have a relatively small area in this embodiment. Because the electrodes are non-conducting where the windows are provided, fewer compensation measures are required to account for the non-conducting windows. In particular, where a shielding structure is also provided between the electrode and the central plane, the shielding structure requires less adaptation to achieve a uniform current density across the area of the workpiece.

In an embodiment of the device, the apertures are aligned in rows extending at least approximately in the second direction.

This contributes to providing uniform flow from the centre to the discharge openings. Generally, there will be at least three e.g. at least five or at least ten apertures in each row. Since the apertures are aligned, each row extends in a straight line. Since the apertures are aligned in rows extending essentially in the second direction (to within customary manufacturing tolerances), the rows extend in parallel to one another.

In an example of the embodiment in which the apertures are aligned in rows extending at least approximately in the second direction, the apertures are uniformly distributed within each row.

That is to say that the spacing between apertures is at least approximately the same for all apertures in a row, there being at least three apertures in each row. In an embodiment, the spacing is the same for a plurality, e.g. a majority, of the rows.

In a particular example of the embodiment in which the apertures are aligned in rows extending at least approximately in the second direction and the apertures are uniformly distributed within each row, the apertures of each row are offset in the second direction with respect to those of at least one other row.

This helps avoid streaks in the first direction where the workpiece is subjected to electrochemical processing.

In a particular example of the embodiment in which the apertures are aligned in rows extending at least approximately in the second direction, the apertures are uniformly distributed within each row and the apertures of each row are offset in a second direction with respect to those of at least one other row, the apertures are aligned in columns extending at an acute angle to the first direction.

Thus, a compromise is achieved between establishing an approximately uniform flow field and preventing streaks on the workpiece.

In an embodiment of the device, the first and second walls are provided with apertures at at least one of (i) a surface density of at least 460 apertures per $m^2$ and (ii) a linear density in the second direction (x) of at least 16 apertures per m.

An effect is to enable relatively thin discrete workpieces (i.e. sheets as opposed to continuous webs) with a thickness in the order of 1-100 μm, e.g. in the order of 5-50 μm to be processed whilst being maintained in the central plane relatively well. This is in particular the case in devices configured such that the central plane—this is the conveyance plane—is an essential horizontal plane.

For devices configured for use in apparatus in which the central plane is an essentially vertical plane, the first and second walls may be provided with apertures at at least one of (i) a surface density of at least 230 apertures per $m^2$ and (ii) a linear density in the second direction (x) of at least 8 apertures per m. A lower number of apertures reduces the manufacturing costs of the device. Where the central plane, i.e. conveyance plane, is an essentially vertical plane, gravity will assist in returning sections of the workpiece that have moved out of the plane back into the plane. Fewer apertures are therefore required for a workpiece of a given thickness.

According to another aspect, the apparatus for wet processing of a planar workpiece according to the invention comprises at least one device according to any one of the preceding claims.

The apparatus comprises one or more cells. At least one cell comprises one or more devices according to the invention. The type of process carried out may differ between cells.

The apparatus may include at least one pump for pumping liquid to the apertures of the or each device according to the invention. The pump(s) thus serve(s) as a source of the pressurised liquid. The apparatus may be configured to drive the or each pump to achieve a particular minimum rate of flow at the discharge openings of the or each device.

In an embodiment of the apparatus, in which the device is a device in which at least one of the discharge openings is formed by a single gap extending between opposing liquid-impervious parts, e.g. edges of the first and second walls, along the extent in the first direction of the space between the surfaces, the apparatus further comprises a conveying device comprising at least one clamp for releasable engaging a workpiece at an edge of the workpiece, guided for movement along a length of the gap, and at least one drive for driving movement of the conveying device.

Thus, the workpiece need only be contacted at one or both of its lateral edges to move the workpiece through the device. The apparatus may include a series of two or more devices of the aforementioned type and a single conveying device for moving the workpiece through the whole series of devices in one embodiment. The conveying device is guided for movement in the first direction.

According to another aspect, the method of operating an apparatus according the invention comprises pumping the liquid through the apertures and through the discharge openings whilst moving a workpiece through the device in the central plane.

The workpiece is kept essentially in the central plane whilst the workpiece moves through the device through the action of the liquid flowing along the surfaces of the workpiece. In particular, the liquid is pumped through at a rate sufficient to ensure that any section of the workpiece moving out of the central plane towards one of the first and second walls gives rise to a local force tending to return that section towards the central plane. The workpiece is a discrete workpiece, i.e. a sheet rather than a continuous or quasi-continuous web. The workpiece will generally be a panel or foil.

According to another aspect, the invention provides for the use of a device and/or apparatus according to the invention to manufacture semiconductor devices, e.g. photoelectric devices.

The device and/or apparatus may in particular be used to manufacture photovoltaic devices. Such devices may be flexible devices. The device and/or apparatus may be used to manufacture interconnects, e.g. in a damascene electroplating process, and/or to fill at least one of trenches and vias, for example.

In a particular embodiment, the device and/or apparatus are used to deposit one or more device layers or precursor layers on a substrate, e.g. a silicon substrate, a glass substrate coated with a transparent conducting oxide, TCO, such as tin oxide (e.g. fluorine-doped tin oxide, FTO, indium tin oxide, ITO) or a molybdenum-coated stainless steel substrate. Where the device and/or apparatus are used to deposit a device layer or precursor layer, the workpiece may subsequently be subjected to a further processing step in a controlled atmosphere, e.g. annealing, laser-scribing, photoresist patterning, etc. In this regard, it is useful that the workpiece can be relatively thin but can be a discrete workpiece. Roll-to-roll processing to deposit the device layer or a precursor layer for forming a device layer is not necessary.

Both absorber layers (or their precursors) and back contact layers can be deposited.

Photovoltaic devices that can be manufactured in this way include CdS/CdTe-based solar cell devices, those incorporating solar cell substrates as ZnTe, ZnSe, ZnS, ZnO and those based on $CuInSe_2$, $Cu_2ZnSnS_4$ or $CuInGaSe_2$ or doped silicon surfaces having a plating base as indium-doped tin oxide. These and further examples are disclosed in e.g. EP 2 709 160 B1.

BRIEF DESCRIPTION OF DRAWINGS

The invention will be explained in further detail with reference to the accompanying drawings, in which.

DESCRIPTION OF EMBODIMENTS

A device 1 for forming part of a cell of an apparatus for wet processing of a planar workpiece comprises first and second liquid distribution devices 2*a,b*.

Figure 4:
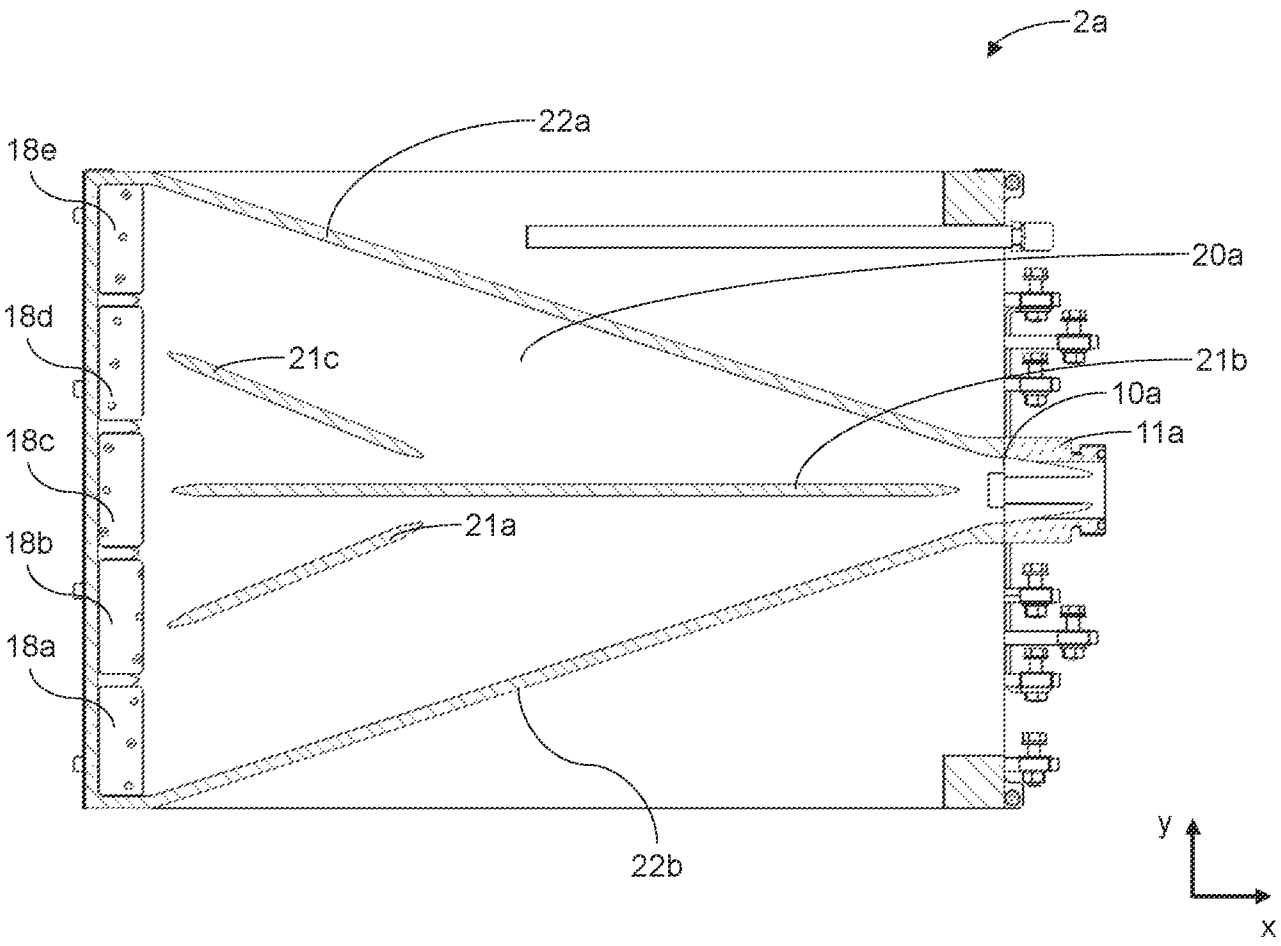
FIG. 4 is a plan cross-sectional view of one of two liquid distribution devices forming part of the cell.

It is convenient to define a first direction y, also referred to herein as a longitudinal direction, and a second direction x, transverse to the longitudinal direction y and also referred to herein as a lateral direction (FIG. 4). In use, the planar workpiece is led through a space 3 (FIG. 1) between the liquid distribution devices 2*a,b* in the first direction y (FIG. 4). The workpiece extends essentially in a central plane 4 (FIG. 2) midway between the first and second liquid distribution devices 2*a,b*. In the example, the central plane 4 is a generally horizontal plane.

In the illustrated example, the device 1 is for forming part of an electroplating cell. Thus, the device 1 further comprises a first and second anode 5*a,b* and first and second shielding structures 6*a,b*.

The shielding structures 6*a,b* may, for example comprise a lattice made of electrically insulating material, e.g. a polymer material. The shielding structures 6*a,b* are liquid-pervious. The anodes 5*a,b* may be made of an electrically conducting, e.g. metal, mesh or other lattice structure. The anodes 5*a,b* are thus also pervious to liquid.

Although two anodes 5*a,b* are shown in the drawings, these anodes 5*a,b* need not extend over the extent of the space 3 in the first direction y. Instead, there may be a series of anodes in a single plane, one after the other in the first direction y. Furthermore, each anode 5*a,b* may be sub-divided into mutually electrically insulated segments in the second direction x.

A conveying device 7 (FIG. 1) is shown only very schematically. The conveying device 7 comprises a clamp 8 for holding the workpiece at one lateral edge thereof. Multiple such conveying devices 7 may be provided to hold the workpiece. A drive 9 is arranged to move the conveying device 7 in the first direction y. The drive 9 may be an endless belt or endless chain, for example. In the electroplating process, the workpiece functions as a cathode. The or each clamp 8 is arranged for electrically contact with the workpiece to establish a voltage difference between the workpiece and the anodes 5*a,b*.

In the illustrated embodiment, the workpiece is held at only one edge. In other embodiments, the workpiece may be held at both opposite edges, seen in the second direction x. In particular, the workpiece may extend beyond the space 3 in the second direction x and be driven by wheels or belts contacting the workpiece at the edges of the workpiece.

Each of the liquid distribution devices 2*a,b* comprises a housing comprising a liquid inlet 10*a,b* for connection to a respective liquid supply conduit 11*a,b*. One or more pumps (not shown) are provided to pump the liquid through the liquid supply conduits 11*a,b*.

A chamber 12*a,b* is defined by the housing. Respective composite walls 13*a,b* comprise a respective housing wall 14*a,b* of each housing and a further wall 15*a,b* placed against the housing wall 14*a,b*. At least facing surfaces of the walls 13*a,b* are essentially parallel to the central plane 4, as are the anodes 5*a,b* and shielding structures 6*a,b*. The component walls 14,15 of each composite wall 13*a,b* may be made of different materials. For example, the further walls 15*a,b* may be made of electrically insulating material. The housing wall 14*a,b* may be made of mechanically stronger material. In an alternative embodiment, the further walls 15*a,b* are omitted. Only one of the component walls 14,15 of each composite wall 13*a,b* need be impervious to liquid, as long as the composite wall 13*a,b* forms a barrier to liquid flow from the central plane 4 towards the liquid distribution devices 2*a,b*.

Figure 1:
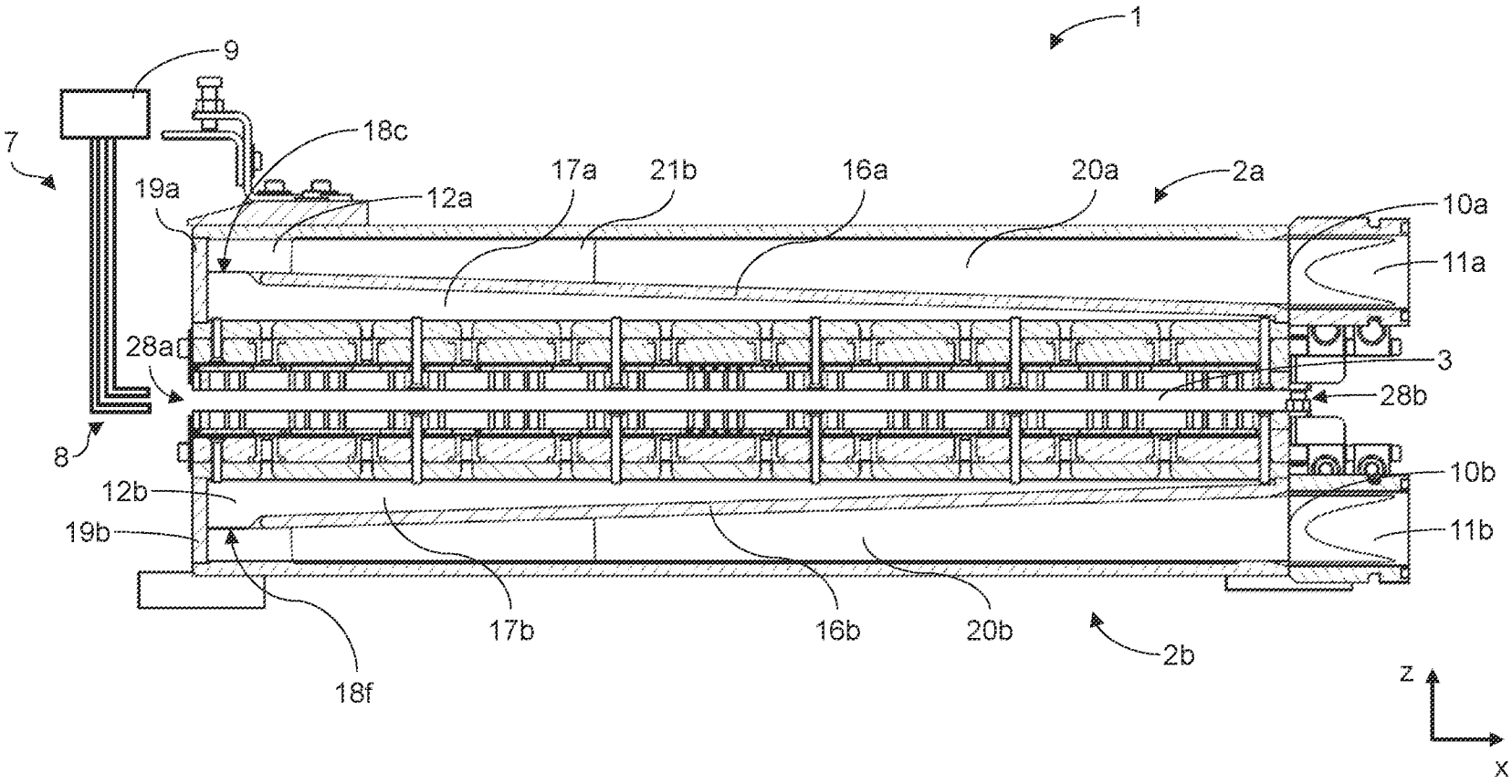
FIG. 1 is a cross-sectional view of part of a cell for electroplating a planar workpiece.
Figure 2:
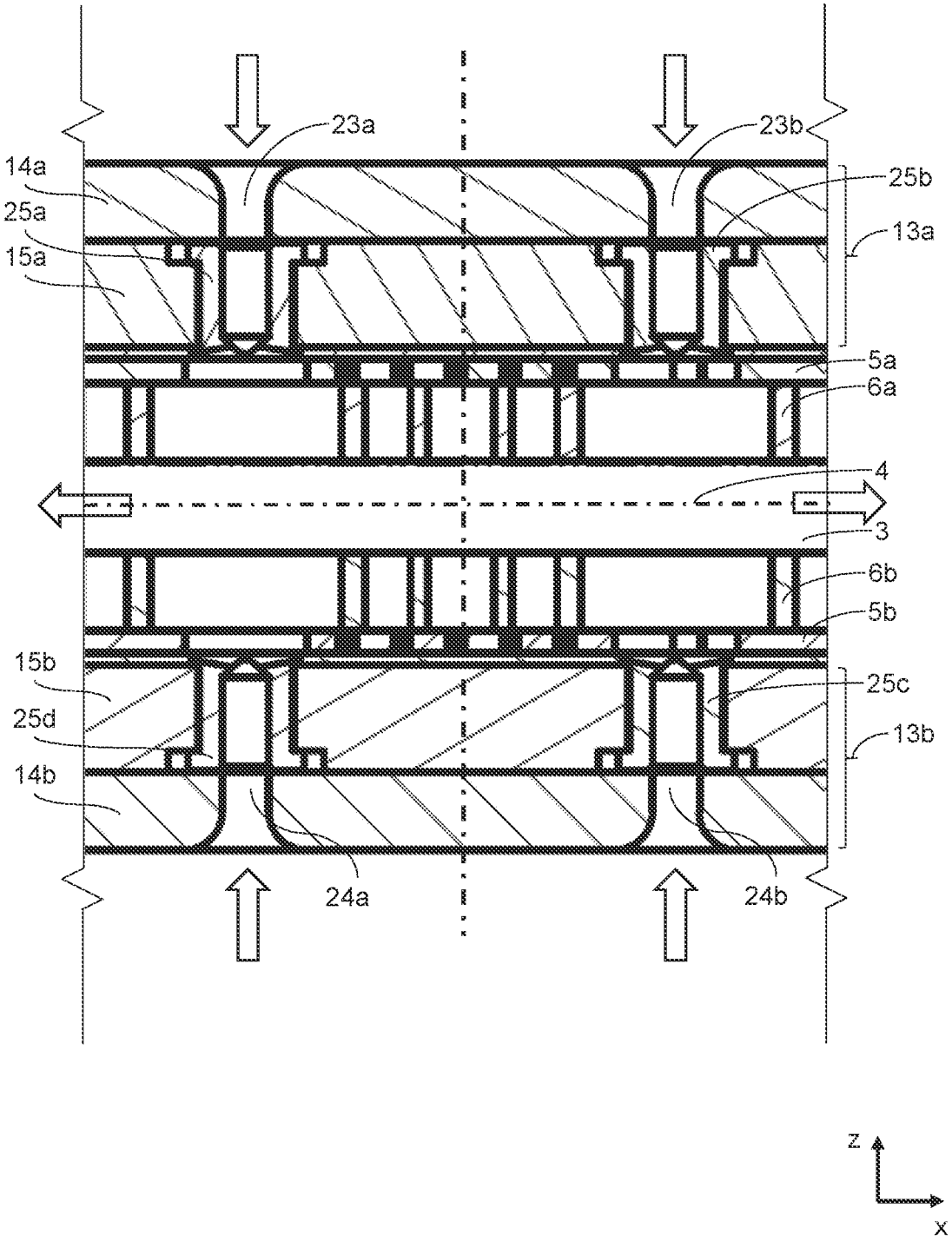
FIG. 2 is a detailed schematic cross-sectional view showing parts of the cell and flow directions of an electrolyte circulating in the cell.

Each chamber 12*a,b* is sub-divided in a third direction z (FIGS. 1 and 2), transverse to the first and second directions x,y by an internal wall 16*a,b* (FIG. 1). Each internal wall 16*a,b* is inclined with respect to the walls 13*a,b* between which the space 3 is defined. A liquid distribution space 17*a,b* is defined between the internal wall 16*a,b* and the wall 13*a,b* closest to the space 3. The liquid distribution space 17*a,b* extends in the first direction y over essentially the entire extent of the wall 13*a,b* in the first direction y in one embodiment. In another embodiment, multiple adjacent liquid distribution spaces 17*a,b* may be provided side-by-side in the first direction y, each extending in the second direction x from one lateral edge of the wall 13*a,b* to the opposite lateral edge.

The liquid distribution space 17 is closed at one lateral end and has an inlet at the opposite lateral end. The liquid distribution space 17 tapers such that the height of the liquid distribution space 17 decreases towards the closed end.

There is at least one gap 18*a-f* (FIGS. 1 and 4) between a free end of the internal wall 16*a,b* and a chamber side wall 19*a,b*. The at least one gaps 18*a-f* together extend along an extent of the chamber 12*a,b* in the first direction y. Each gap 18*a-f* provides for liquid communication between the liquid distribution space 17 and a divergent liquid conduit 20*a,b* defined in the chamber 12*a,b*. An inlet side of the divergent liquid conduit 20*a,b* is connected to the liquid inlet 10*a,b*. An outlet side is situated at the gaps 18*a-f*. In the illustrated embodiment, flow guides 21*a-c* (FIG. 3) are provided at the outlet side. The flow guides 21*a-c* sub-divide the divergent liquid conduit 20*a,b* into parallel channels, in this example four channels. Side walls 22*a,b* of the divergent liquid conduit 20 are straight in the illustrated example, but could alternatively be curved.

Each of the walls 13*a*, between which the space 3 between the liquid distribution devices 2*a,b* is located is provided with a plurality of channels 23*a,b*, 24*a,b* (FIG. 2) terminating in apertures for introducing liquid into the space 3. In the illustrated embodiment, the channels 23*a,b*, 24*a,b* are oriented with their longitudinal axes substantially perpendicular to the central plane 4.

In the illustrated embodiment, the further walls 15*a,b* are support walls, e.g. made of plastic. Threaded through-bores are provided in the further walls 15*a,b*, in which nozzle devices 25*a-d* (FIG. 2) are inserted. Alternatively, the nozzle devices 25*a-d* can be pressed into the through-bores. The nozzle devices 25*a-d* completely fill the through-bores, such that liquid can only pass through the further walls 15*a,b* through the nozzle devices 25*a-d*. Thus, a section of each of the channels 23*a,b*, 24*a,b* is defined by one of the nozzle devices 25*a-d*.

The nozzle devices 25*a-b* are fan nozzle devices 25*a-d*, which shape the stream of liquid emerging from each nozzle devices 25*a-d*. To this end, a constriction forms an orifice 26 (FIG. 3) having an elongated shape with a larger dimension in the second direction x than in the first direction y. The same is the case for an exit aperture 27 through which the liquid enters the space 3. This exit aperture 27 is slit-shaped in the illustrated embodiment.

Gaps 28*a,b* are defined between the walls 13*a,b* at the lateral edges of the walls 13*a,b*. These gaps 28*a,b* each extend along essentially the extent of the walls 13*a,b* in the first direction y.

The liquid thus flows from the middle outwards in the second direction x, in use. The liquid distribution space 17 and divergent liquid conduit 20 ensure that liquid is introduced into the space 3 at a relatively uniform rate, so that the flow accelerates towards the lateral edges of the workpiece. As a result, a self-centring effect is achieved, keeping the workpiece in the central plane without the need for supports that contact the workpiece. Nevertheless, the shielding structures 6*a,b* ensure that contact with the anodes 5*a,b* is prevented under all circumstances.

An example of the device 1 is configured for workpieces having a thickness of up to 100 μm, e.g. up to 60 μm, up to 50 μm, or even up to 10 μm. Typical dimensions for the height of the gaps 28*a,b* are in the range of 2-50 mm. Liquid is pumped at such a rate that the velocity at the gaps 28*a,b* is at least 0.1 m/s, e.g. at least 0.5 m/s. The velocity will generally be below 10 m/s, and may be below 5 m/s.

The shielding structures 6*a,b* are spaced apart (in the direction perpendicular to the central plane 4) by at least 5 mm and at most 25 mm, e.g. at most 20 mm or even less than 15 mm. A distance from each anode 5*a,b* to the central plane 4 is at least 8 mm, e.g. at least 10 mm, and generally at most 15 mm, e.g. at most 12 mm.

Figure 3:
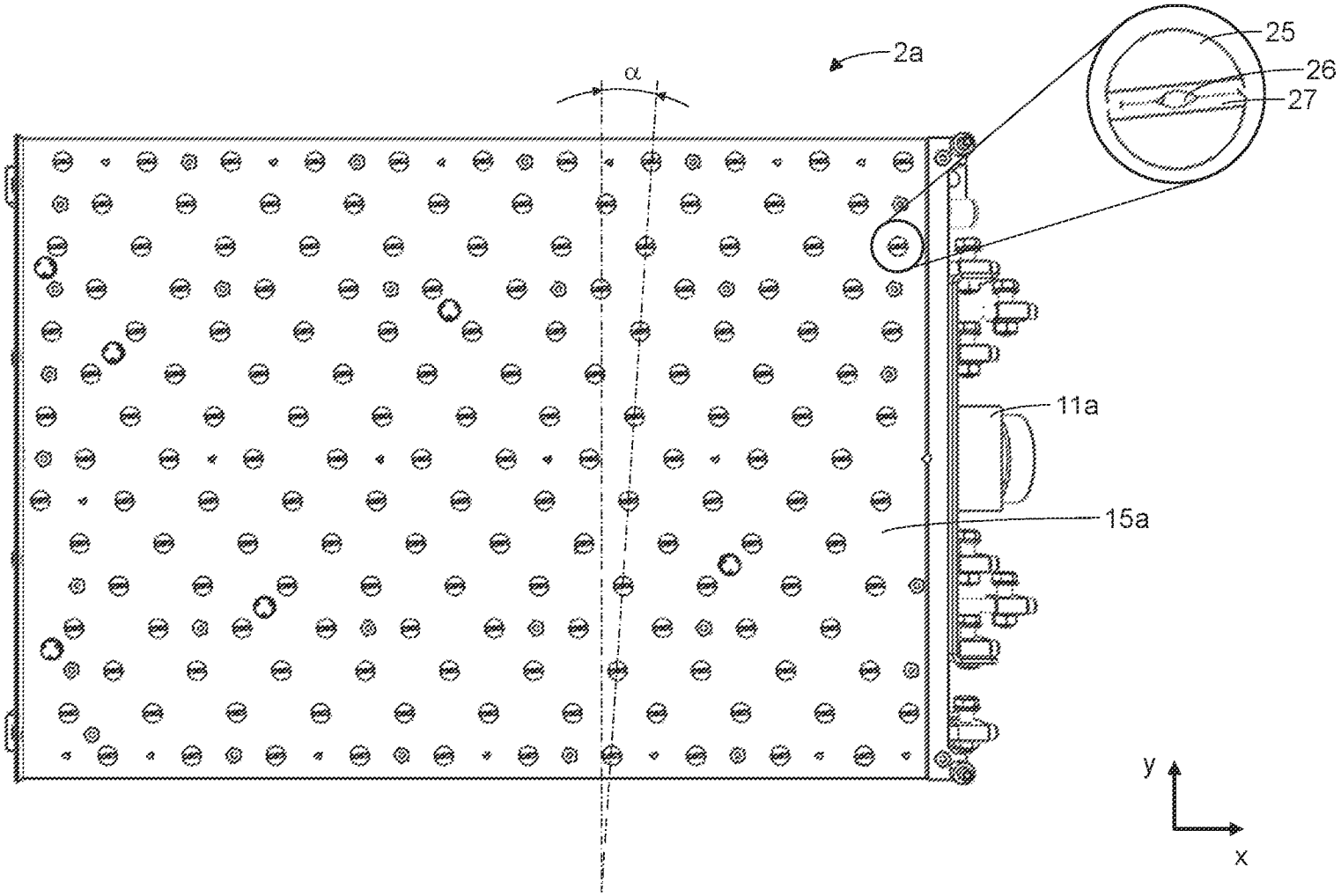
FIG. 3 is a plan view of one of two walls between which a workpiece is movable through the cell.

In the illustrated embodiment, the nozzle devices 25*a-d* are arranged in rows extending essentially in parallel to the second direction x. The mutual spacing between the apertures and thus the nozzle devices 25*a-d* is equal within each row. In the illustrated embodiment, this spacing is also the same for all the rows. However, the nozzle devices 25*a-d* of each next row in the first direction y are offset in the second direction x with respect to the nozzle devices 25*a-d* in the preceding row. The offset is the same for each pair of rows, the spacing between rows in the first direction y also being uniform. As a consequence, the nozzle devices 25*a-d* can be said to be arranged in columns that are at a slight angle $\alpha$ to the first direction y (FIG. 3). A further consequence is that the number of nozzle devices 25*a-d* can be ten or eleven. The spacing is such as to achieve a linear density of at least 16 apertures 27 per m in the second direction x. In the illustrated embodiment, the surface density is at least 460 per $m^2$, e.g. at least 600 per $m^2$. Thus, the dimension of the walls 13*a,b* in the first direction y is at most 500 mm, e.g. between 400 and 450 mm. The dimension in the second direction x is at most 700 mm, e.g. between 600 and 650 mm. For these dimensions, there are at least 120 apertures 27 per wall 13*a,b*.

The invention is not limited to the embodiments described above, which may be varied within the scope of the accompanying claims. For example, although the apparatus of the example is one having a horizontal conveyance plane (referred to as the central plane 4 herein), the same effects are achievable in an apparatus having a vertical conveyance plane. In such a device, the flow field described herein is achievable by submerging the device 1 relatively far into a liquid bath, such that the liquid emerging from the upper one of the gaps 28*a,b* does not squirt into free space. In embodiments having a vertical conveyance plane, the dimension in the first direction x can be larger, e.g. up to 1300 mm. The minimum number of nozzle devices 25*a-d* per unit area, as well as the minimum linear density in the second direction x can be about half the values given above for the embodiment having a horizontal conveyance plane without forgoing the effect of keeping the workpiece in the central plane relatively well.

In an apparatus comprising multiple devices 1 arranged in series, the spacing between the shielding structures 6*a,b* may decrease in the first direction y.

The space accessible to liquid need not be completely empty, as long as it can be penetrated by the liquid. Thus, sections of that space may be filled with a porous structure, e.g. foam. This could, for example, serve as a spacer between the walls 13*a,b* and the anodes 5*a,b* and/or between the anodes 5*a,b* and the shielding structures 6*a,b*.

LIST OF REFERENCE NUMERALS

1—Device
2*a,b*—Liquid distribution devices
3—Space
4—Central plane
5*a,b*—Anodes
6*a,b*—Shielding structures
7—Conveying device
8—Clamp
9—Drive
10*a,b*—Liquid inlets
11*a,b*—Liquid supply conduit
12*a,b*—Chamber
13*a,b*—First and second composite walls
14*a,b*—Housing walls
15*a,b*—Further walls
16*a,b*—Internal walls
17*a,b*—Liquid distribution space
18*a-f*—Gaps in chambers
19*a,b*—Chamber side walls
20*a,b*—Divergent liquid conduit
21*a-c*—Flow guides
22*a,b*—Divergent conduit side walls
23*a,b*—First channels
24*a,b*—Second channels
25*a-b*—nozzle devices
26—orifice
27—exit aperture
28*a,b*—Gaps

The invention claimed is:

1. Device for a cell of an apparatus for wet electrolytic treatment processing of a planar workpiece, comprising:

a structure comprising first and second walls, wherein the workpiece is movable in a central plane through a space internal between the first and second walls in a first direction (y), wherein apertures for introducing pressurised liquid between the first and second walls are provided on opposite sides of the central plane and facing the central plane, wherein the apertures are distributed in the first direction (y) and in a second direction (x) transverse to the first direction (y), wherein discharge openings for the liquid to leave the space are defined on opposite sides of the space, seen in the second direction (x), along an extent of the space in the first direction (y), and wherein the first and second walls form barriers to liquid flow from the space in a direction (z) perpendicular to the central plane, wherein channels are provided through the first and second walls, each channel arranged to conduct liquid to a respective one of the apertures; and at least one liquid distribution space extending in the second direction (x) across inlets of the channels is delimited by a barrier wall disposed external to and on an opposite side of at least one of the first and second walls away from the space, wherein the at least one liquid distribution space has a height defined by the barrier wall, and said height decreases with respect to at least one of the first and second walls towards an opposite edge and forms a closed end of the liquid distribution space.

2. Device according to claim 1, wherein the apertures are defined in surfaces of the first and second walls at ends of the respective channels.

3. Device according to claim 1, further comprising first and second liquid distribution devices, wherein the first and second walls comprise walls of the first and second liquid distribution devices, respectively, and wherein the first and second liquid distribution devices are mounted such that the space extends between the liquid distribution devices.

4. Device according to claim 1, further comprising at least one divergent liquid conduit, having an inlet connectable to a liquid supply conduit on one side and widening towards an opposite side that is in liquid communication with the liquid distribution space at multiple locations along a width of the divergent liquid conduit.

5. Device according to claim 4, wherein the at least one divergent liquid conduit and the liquid distribution space are defined within a chamber within a housing of one of the first and second liquid distribution devices by the barrier wall extending within the chamber.

6. Device according to claim 1, wherein at least one of the discharge openings is formed by a single gap extending between opposing liquid-impervious parts, along the extent in the first direction (y) of the space.

7. Device according to claim 1, further comprising at least one liquid-pervious electrode, extending in a plane between the central plane and one of the first and second walls.

8. Device according to claim 1, further comprising at least one liquid-pervious shielding structure, extending in a plane between the central plane and one of the first and second walls.

9. Device according to claim 1, wherein nozzles extending to the apertures are provided in the first and second walls.

10. Device according to claim 9, wherein orifices of the nozzles are provided with an elongated shape having a larger dimension in the second direction (x) than in the first direction (y).

11. Device according to claim 1, wherein the apertures are aligned in rows extending at least approximately in the second direction (x).

12. Device according to claim 11, wherein the apertures are uniformly distributed within each row.

13. Device according to claim 12, wherein the apertures of each row are offset in the second direction with respect to those of at least one other row.

14. Device according to claim 13, wherein the apertures are aligned in columns extending at an acute angle ($\alpha$) to the first direction (y).

15. Device according to claim 1, wherein the first and second walls are provided with apertures at at least one of (i) a surface density of at least 460 apertures per $m^2$ and (ii) a linear density in the second direction (x) of at least 16 apertures per m.

16. Apparatus for wet processing of a planar workpiece, comprising at least one device according to claim 1.

17. Apparatus according to claim 16, further comprising at least one pump for pumping liquid to the apertures.

18. Device according to claim 2, further comprising first and second liquid distribution devices, wherein the first and second walls comprise walls of the first and second liquid distribution devices, respectively, and wherein the first and second liquid distribution devices are mounted such that the space extends between the liquid distribution devices.

19. Device according to claim 1, wherein the barrier wall is in contact with the first and second walls at only one end of the first and second walls.

* * * * *